US006474319B1

(12) United States Patent
Hough et al.

(10) Patent No.: US 6,474,319 B1
(45) Date of Patent: Nov. 5, 2002

(54) FILTER SYSTEM FOR THE REMOVAL OF HYDROCARBON DEPOSITS FROM A COOLED EXHAUST GAS RECIRCULATING ENGINE

(75) Inventors: Walter J. Hough, John's Island, SC (US); Cheng G. Li, Columbus, IN (US); Ying Zhou, Tigard, OR (US)

(73) Assignee: Cummins Engine Company, Inc., Columbus, IN (US)

( * ) Notice: Subject to any disclaimer, the term of this patent is extended or adjusted under 35 U.S.C. 154(b) by 0 days.

(21) Appl. No.: 09/690,495

(22) Filed: Oct. 17, 2000

(51) Int. Cl.[7] ..... F02M 25/07
(52) U.S. Cl. ..... 123/568.11; 123/568.12
(58) Field of Search ..... 60/278, 279, 299, 60/300, 311, 605.2; 123/568.11, 568.12; 55/523, 527

(56) References Cited

U.S. PATENT DOCUMENTS

| | | | | |
|---|---|---|---|---|
| 4,356,806 A | * | 11/1982 | Freesh | 123/568.12 |
| 4,455,393 A | | 6/1984 | Domesle et al. | 502/347 |
| 4,477,417 A | | 10/1984 | Domesle et al. | 423/213.2 |
| 4,515,758 A | | 5/1985 | Domesle et al. | 423/213.2 |
| 4,588,707 A | | 5/1986 | Domesle et al. | 502/225 |
| 4,649,703 A | | 3/1987 | Dettling et al. | 60/275 |
| 4,924,668 A | | 5/1990 | Panten et al. | 60/278 |
| 4,929,581 A | | 5/1990 | Steinwandel et al. | 502/2 |
| 5,085,049 A | | 2/1992 | Rim et al. | 60/274 |
| 5,453,116 A | * | 9/1995 | Fischer et al. | 55/527 |
| 5,536,477 A | * | 7/1996 | Cha et al. | 60/300 |
| 5,601,068 A | * | 2/1997 | Nozaki | 123/568.12 |
| 5,671,600 A | * | 9/1997 | Pischinger et al. | 123/568.12 |
| 5,737,918 A | | 4/1998 | Khinsky et al. | 60/297 |
| 5,785,030 A | * | 7/1998 | Paas | 123/568.12 |
| 5,802,846 A | * | 9/1998 | Bailey | 123/568.12 |
| 5,806,308 A | * | 9/1998 | Khair et al. | 123/568.12 |
| 6,138,649 A | * | 10/2000 | Khair et al. | 123/568.12 |
| 6,322,605 B1 | * | 11/2001 | He et al. | 60/311 |

FOREIGN PATENT DOCUMENTS

| | | | |
|---|---|---|---|
| JP | 3-222808 | * 10/1991 | 123/568.12 |

* cited by examiner

*Primary Examiner*—Willis R. Wolfe
(74) *Attorney, Agent, or Firm*—Woodard, Emhardt, Naughton, Moriarty & McNett

(57) ABSTRACT

The present invention relates to a method and apparatus for removing hydrocarbons from the exhaust stream of a diesel engine prior to cooling the exhaust for recycling through the intake manifold. A filter is used to remove hydrocarbon combustion products, including particulate matter, from the exhaust at a point after the exhaust gasses leave the exhaust manifold and before the exhaust gasses enter an exhaust gas cooler. Reduction of the hydrocarbon levels in the exhaust gasses slows or prevents buildup of hydrocarbon residue downstream of the filter, such as in the exhaust gas cooler, reducing the frequency of the requirement for cleaning or replacing the filter and effectively extending the life of the exhaust system.

9 Claims, 5 Drawing Sheets

FILTER SYSTEM FOR THE REMOVAL OF HYDROCARBON DEPOSITS FROM A COOLED EXHAUST GAS RECIRCULATING ENGINE

TECHNICAL FIELD OF THE INVENTION

The present invention relates generally to internal combustion engines and, more particularly, to a system for the removal of hydrocarbons from engine exhaust gasses and a reduction of hydrocarbon deposits in the engine interior.

BACKGROUND OF THE INVENTION

Internal combustion engines do not burn fuel very efficiently, and as a result produce exhaust gasses containing by-products of incomplete combustion, such as carbon monoxide, nitrous oxides, and a variety of hydrocarbons. Even diesel engines, which use a higher air-to-fuel ratio than do gasoline (Otto cycle) engines, produce excessive nitrous oxides along with carbon monoxide and some hydrocarbons. These combustion by-products are undesirable because they are both harmful to the environment and wasteful.

Carbon monoxide is a known greenhouse gas and is also toxic in large quantities, since it is preferentially absorbed over oxygen in red blood cells. Some nitrous oxides are also toxic, and contribute to acid rain. And among the plethora of hydrocarbons produced by inefficient combustion are carcinogenic benzpyrene and nitroaromates. Inefficient combustion is also wasteful insofar as the carbon monoxides, nitrous oxides, and hydrocarbons may yet be further oxidized to release potential chemical energy stored within.

One method of removing inefficient combustion by-products known in the art is to pass the exhaust stream through an afterburner to fully oxidize the by-products therein. While this technique is effective in removing the combustion by-products from the environment, it is inefficient in that afterburning is an endothermic process, actually taking more energy to perform and so further reducing the engine's efficiency.

Another method of removing inefficient combustion by-products known in the art is by using a trap to remove the by-products form the exhaust stream prior to its emission into the environment. Traps are most effective in removing hydrocarbons (soot) from the exhaust stream, and less effective at removing carbon monoxide and/or nitrous oxides. Further, traps must frequently be purged of the entrapped hydrocarbons so as not to become choked and block the engine exhaust stream, thus increasing ram pressure and decreasing engine power and efficiency. Purging may be accomplished by physically removing and cleaning the trap or through the application of heat to the trap sufficient to oxidize the entrapped hydrocarbons. In either event, purging the trap is time and/or energy consuming.

Another method known in the art of removing inefficient combustion by-products from engine exhaust is by routing some of the engine exhaust back into the air intake, such that the partially oxidized combustion by-products may be completely oxidized by the engine. This is known as exhaust gas recycling. While this method is efficient in reducing the level of inefficient combustion by-products (especially nitrous oxides and carbon monoxide) ultimately emitted by the engine, the exhaust gasses must first be cooled before being reintroduced into the engine in order to control the combustion process. Cooling is accomplished by routing the hot exhaust gasses through a cooling chamber. During cooling, hydrocarbons in the exhaust gas stream tend to condense or otherwise accumulate in the cooling chamber, eventually clogging it and necessitating a purge procedure similar to the one described above for the trap.

There is therefore a need for a way of preventing the accumulation of hydrocarbon residue from accumulating in the cooling chamber of an exhaust gas recycling system. The present invention addresses this need.

SUMMARY OF THE INVENTION

The present invention relates to a method and apparatus for at least partially removing hydrocarbons from the exhaust stream of an internal combustion engine as or shortly after the exhaust gasses leave the exhaust manifold and prior to cooling the exhaust for recycling through the intake manifold. In a preferred embodiment, a filter is placed in the exhaust gas stream substantially adjacent the exhaust manifold, allowing the removal of hydrocarbon combustion by-products from the exhaust gasses at a point before the exhaust gasses can travel downstream of the exhaust manifold and deposit hydrocarbon residue within the exhaust gas recycling system (i.e., the exhaust gas transfer pipes or conduits and other exhaust gas processing devices). This is especially important in engine systems employing exhaust gas recirculation technology, since the exhaust gas recirculation conduits and exhaust gas recirculation cooler generally comprise a closed-loop system that requires expensive time and labor to clean or replace and is susceptible to clogging from residual hydrocarbon condensation and deposition from the cooling exhaust gasses circulating therethrough.

The filter may include a catalyst material to facilitate the removal of combustion by-products at the temperatures typical of engine exhaust gasses. Alternately, the filter may instead include means to heat the exhaust gasses passing therethrough sufficiently to ensure more efficient removal of the combustion by-products. Still alternately, the filter may feature a combination of both a catalyst and heating means. The filter removes hydrocarbons from the exhaust gasses as they leave the exhaust manifold, reducing the hydrocarbon levels in the exhaust gasses so as to slow or prevent buildup of hydrocarbon residue further downstream. The filter may operate to oxidize the hydrocarbons and other combustion by-products as the exhaust gasses pass therethrough, it may trap the hydrocarbons for periodic thermal purging in which the hydrocarbon build-up in the filter is bulk oxidized, or it may do both.

One object of the present invention is to provide an improved internal combustion engine exhaust system. Related objects and advantages of the present invention will be apparent from the following description.

DETAILED DESCRIPTION OF THE PREFERRED EMBODIMENT

Figure 1:
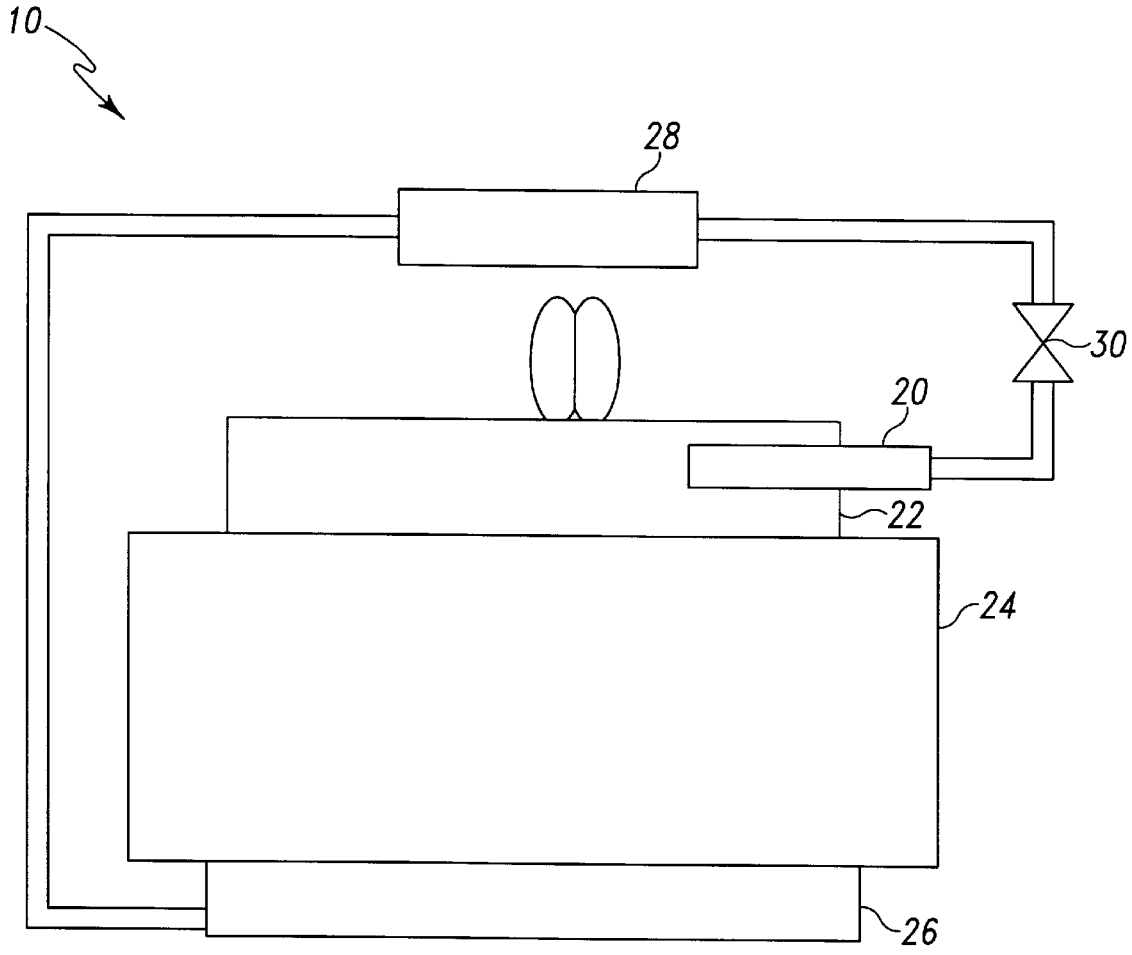
FIG. 1 is a schematic view of a first embodiment exhaust gas filtration system of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

FIG. 1 schematically illustrates a first embodiment of the present invention, a filter system 10 for removing volatile combustion by-products, such as hydrocarbons, carbon monoxide, nitrous and nitric oxides (Nox) from exhaust gasses produced by incomplete combustion of petroleum-based fuel oils. The filter system 10 includes a filter 20 fluidically connected to the exhaust manifold 22 of an internal combustion engine 24. In this embodiment, the internal combustion engine is a diesel engine, but in other embodiments the filter system 10 may be adapted to work with any convenient internal combustion engine 24. The diesel engine 24 receives air through an air intake 26 manifold fluidically connected thereto. The filter 20 is positioned adjacent or partially within the exhaust manifold 22, such that while the engine 24 is running the filter 20 is heated by the exhaust manifold 22 and is maintained at a temperature of at least about 350° F., and, more preferably, in excess of about 450° F. The filter 22 is also fluidically connected to an exhaust gas recirculation (EGR) cooler 28, which is in turn fluidically connected to the air intake manifold 26. An EGR valve 30 is connected in fluid communication with the filter 20 and the EGR cooler 28, such that the fluid flow from the filter 20 to the EGR cooler 28 may be independently regulated or interrupted. The EGR valve 30 is preferentially fluidically connected between the filter 20 and the EGR cooler 28, although the EGR valve 30 may be positioned anywhere in the system 10 convenient to the regulation of fluid flow through the filter 20.

In operation, the filter 20 receives at least some of the exhaust gasses emitted from the exhaust manifold 22. The filter 20 acts to remove volatile combustion by-products from the exhaust gasses that would otherwise become trapped as residual buildup in the EGR cooler 28. The EGR cooler 28 operates to cool exhaust gasses for reintroduction into the engine 24 through the air intake manifold 26. If the EGR cooler 28 becomes clogged or blocked (for example, by hydrocarbon buildup), more energy is required to force the exhaust gasses therethrough (overcoming mounting backpressure), and the efficiency of the EGR cooler 28 and the engine 24 is accordingly reduced. Further, if hydrocarbons or other combustion by-product particles are carried from the EGR cooler 28 to the air intake manifold 26 to deposit within the engine 24, additional engine wear may result.

Figure 2A:
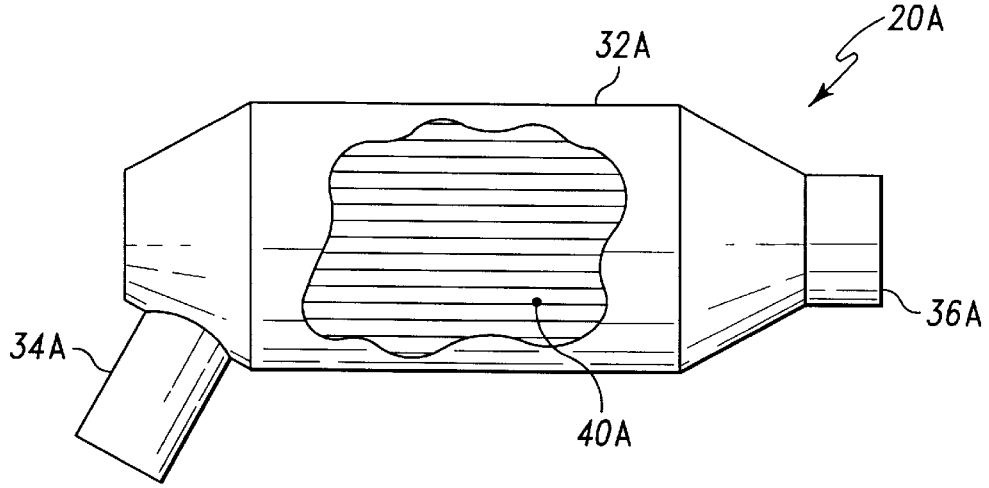
FIG. 2A is a partial sectional plan view of a first filter used in the embodiment of FIG. 1.
Figure 2B:
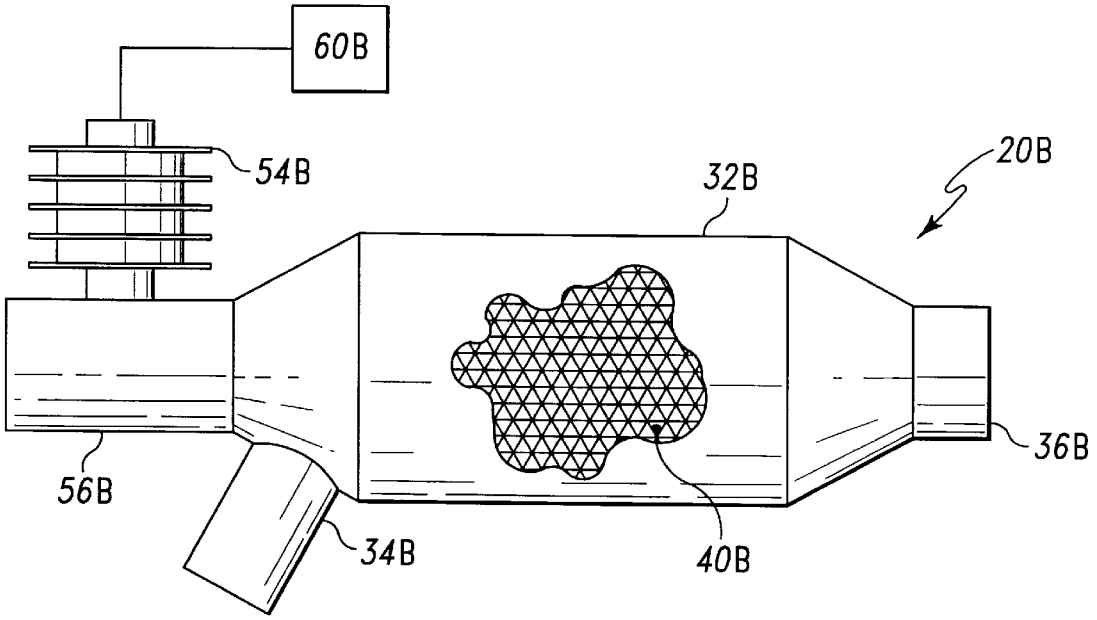
FIG. 2B is a partial sectional plan view of a second filter used in the embodiment of FIG. 1.
Figure 3A:
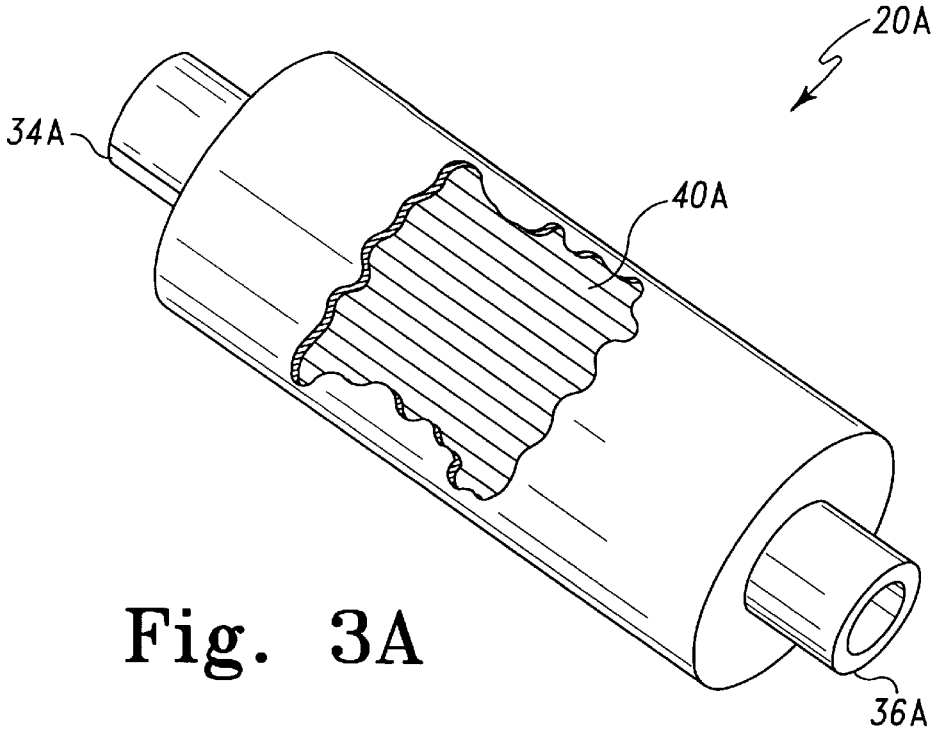
FIG. 3A is a partial sectional perspective view of the filter of FIG. 2A.
Figure 3B:
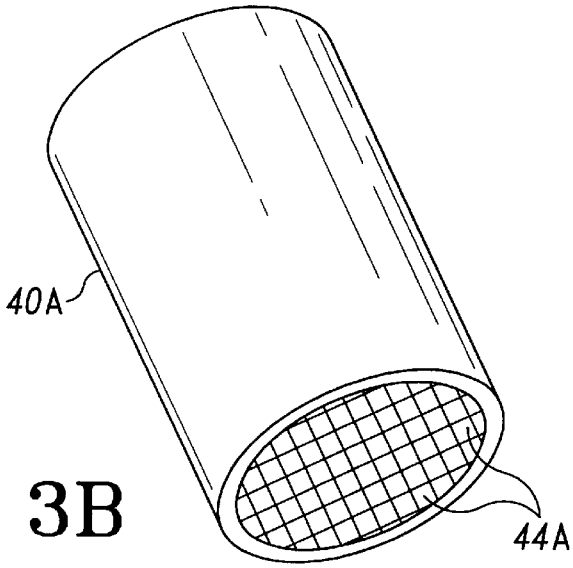
FIG. 3B is a perspective view of the filter element of FIG. 3A.
Figure 3C:
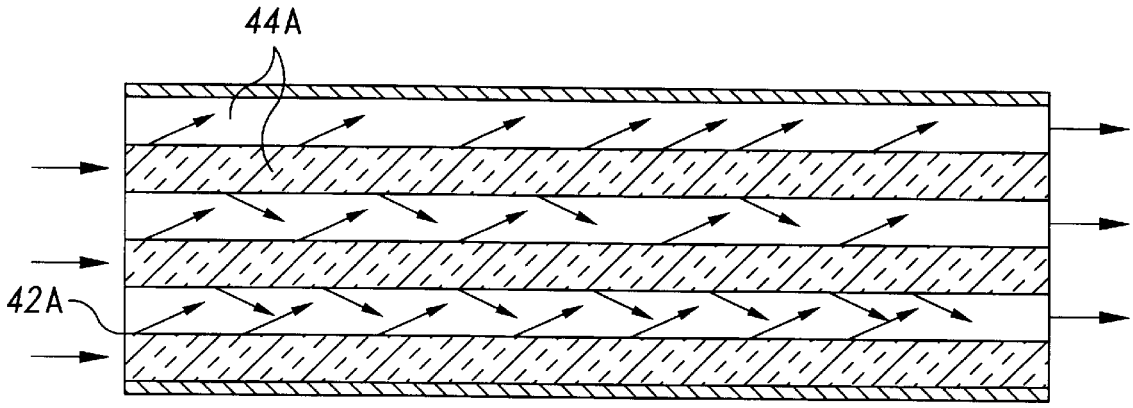
FIG. 3C is a sectional schematic view of the pore structure of the filter element of FIG. 3A illustrating exhaust gas flow therethrough.
Figure 3D:
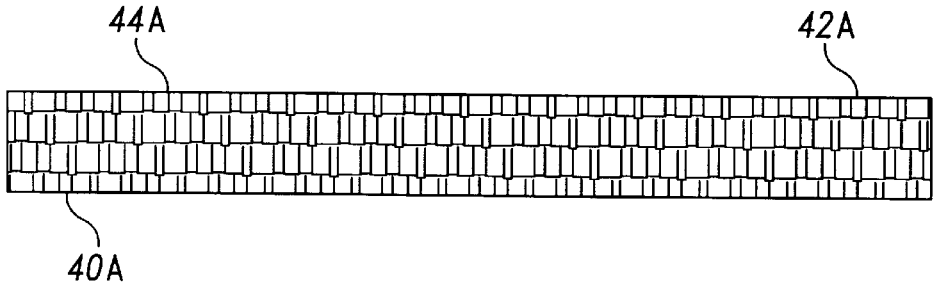
FIG. 3D is sectional view of the filter element of FIG. 3A illustrating the metal coating on the pores.

FIGS. 2A and 2B illustrate the filter 20 in greater detail. FIGS. 2A and 3A–D illustrate a first embodiment filter 20A, which operates to remove hydrocarbons from exhaust gasses by catalytically oxidizing them. Filter 20A includes a filter body 32A adapted to receive fluids through an inlet 34A and expel them through an outlet 36A. The filter body 32A (see FIG. 3A) contains a porous refractory filter element 40A (see FIG. 3B) having a catalytic precious metal 42A coating at least some of the pores 44A, such that exhaust gasses flowing therethrough are forced into contact with the catalyst metal 42A as they transition through the filter 20A (see FIGS. 3C–D). The refractory body 40A may be made of any convenient ceramic or other refractory material capable of withstanding the temperatures and temperature differentials experienced in or near the engine exhaust manifold 26. One preferred refractory material is cordierite, although any porous refractory material having sufficient chemical stability may be used. The pores may be inherent in the refractory body 40A, or they may be formed later through any convenient machining process.

The catalyst metal 42A is preferably cerium, palladium, platinum, and/or rhodium, as these are materials metals known to readily catalyze the oxidation of hydrocarbons. The catalyst metal 42A is more preferably a combination of cerium with palladium, platinum, and/or rhodium. The catalyst metal 42A catalyzes oxidation of hydrocarbons in the exhaust gasses at temperatures as low as about 400° F., thereby allowing the hydrocarbons in the exhaust gasses to be broken down into water and carbon dioxide (or at least carbon monoxide) oxidation products. Cerium will begin to catalyze the oxidation of hydrocarbons at temperatures as low as about 350° F., while palladium, platinum and rhodium begin to catalyze oxidation of hydrocarbons at about 800–900° F. While Pa, Pt, and Rh have the advantage of being extremely stable at elevated temperatures and under a wide variety of chemical and pH environments, they have the disadvantages of being expensive and of having a high hydrocarbon catalysis threshold temperature (relative to the temperature of typical engine exhaust gasses). Since oxidation is an exothermic reaction, a catalyst metal 42A including a combination of Ce with Pa, Pt, and/or Rh can therefore begin to catalyze oxidation of carbonaceous materials in the exhaust gas stream with the Ce portion of the catalyst metal 42A at the lower temperature of about 400° F. (typical of engine exhaust gasses) until the heat produced by the oxidation reaction raises the temperature of the catalyst metal 42A sufficiently for the Pa, Pt, and/or Rh portions of the catalyst metal 42A to participate in the catalysis process. It is desirable to oxidize the carbonaceous materials in the exhaust gas stream at as high a temperature as possible, since high temperatures are more efficient for complete oxidation of the heavier carbonaceous materials (for example, long chain hydrocarbon molecules) as well as for any other, non-carbonaceous volatile combustion by-products (such as, for example, NOx). The oxidation products are then expelled through the outlet 36A to be carried along with the rest of the exhaust gasses into the EGR cooler 28 for return to the engine 24 through the exhaust manifold 26.

Figure 4:
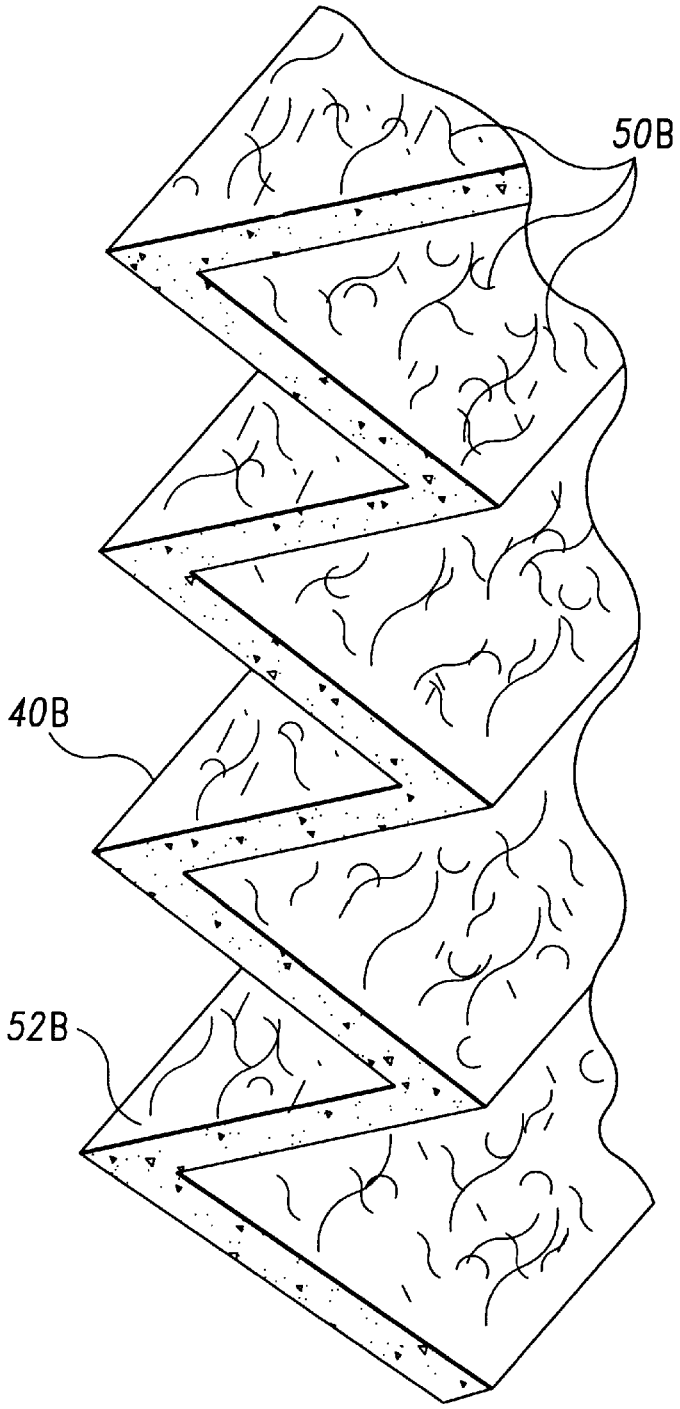
FIG. 4 is a partial sectional perspective view of the filter element of FIG. 2B.

FIG. 2B illustrates a second embodiment of the filter 20B of the present invention, operative to remove volatile combustion by-products from the exhaust gasses flowing therethrough. Filter 20B includes a filter body 32B having a filter inlet 34B for receiving fluids and a filter outlet 36B for expelling fluids. Filter 20B further includes a filter element 40B containing microwave-absorbing fibers 50B (see FIG. 4). The microwave-absorbing fibers 50B are preferably incased in a refractory paper matrix 52B, and are more preferably formed from silicon carbide.

The filter 20B further includes a microwave generator 54B (such as a magnetron) operationally connected to a waveguide 56B. The waveguide 56B is positioned to direct microwaves generated by the microwave generator 54B at the filter element 40B. In operation, hydrocarbons from the exhaust gasses passing through the filter 20B collect on the filter element 40B. The filter element 40B is then routinely purged by a microwave-induced heat treatment. Microwaves from the microwave source 54B are directed through the waveguide 56B to the filter element 40B, where they are exothermically absorbed by the microwave-absorbing fibers 50B. The heat generated by the absorption of the microwaves raises the temperature of the filter element 40B sufficiently to oxidize the hydrocarbon residue collected thereon. The resulting water vapor, carbon dioxide and/or carbon monoxide is expelled through the outlet 36B, cooled in the EGR cooler 28, and reintroduced into the engine 24 through the intake manifold 26. The microwave source 54B may be adapted to automatically activate or may be activated by an electronic controller 60B operationally coupled thereto.

In operation, the filter system 10 of the present invention operates to remove hydrocarbons and other volatile combustion by-products from the exhaust stream of an internal combustion engine 24 while the engine 24 is running by providing an exhaust gas filter 20 positioned downstream from the exhaust manifold 22 and adapted to receive at least some of the exhaust gasses emitted therefrom. The filter 20 is preferably positioned as close as possible to the exhaust gas manufold 22. The hot exhaust gasses from the exhaust manifold 22 are circulated through the filter 20, wherein at least some of the hydrocarbon content of the exhaust gasses is removed. Preferably, the filter temperature is maintained high enough that at least some of the hydrocarbons and other engine volatile combustion by-products are at least partially oxidized while in the filter 20. More preferably, the amount of volatile combustion by-products of all kinds is substantially reduced as the exhaust gasses passes through the filter 20. The exhaust gasses may then circulated from the filter 20 to the atmosphere. Alternately, the exhaust gasses may be circulated from the filter 20 to the engine's air intake manifold 26. Preferably, the exhaust gasses are cooled before being introduced into the air intake manifold 26. Cooling of the filtered exhaust gasses is preferably accomplished by circulating them through an EGR cooler 28 prior to circulating them into the air intake manifold 26.

One preferred method of removing the hydrocarbons from engine exhaust gasses is to deposit the hydrocarbons within the filter 20, and then occasionally heat the filter 20 sufficiently to oxidize the trapped hydrocarbons. Another preferred method of filtering the hydrocarbons from the exhaust gasses is to catalyze the oxidation of the exhaust gasses within the filter 20, making use of the proximity of the filter 20 to the exhaust manifold to maintain the filter 20 at a temperature sufficient to support catalytic oxidation of the hydrocarbons. Preferred catalysts include Ce and/or refractory elements from column VIIIA, rows 5 and 6 of the periodic table (such as Pt, Pd, and Rh), although any convenient element, alloy, or compound having the desired thermal stability and catalytic properties may be used.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are to be desired to be protected.

What is claimed is:

1. A system for reducing hydrocarbon deposits in an exhaust gas recirculation cooler in an internal combustion engine, comprising:

an air intake;

an internal combustion engine connected in fluidic communication with the air intake;

an exhaust manifold connected in fluidic communication with the internal combustion engine;

a hydrocarbon filter connected in fluidic communication with the exhaust manifold further comprising:

a porous refractory substrate adapted to allow, fluidic communication therethrough; and a catalytic metal coating at least some of the pores;

an exhaust gas recirculation cooler connected in fluidic communication with the hydrocarbon filter and connected in fluidic communication to the air intake; and a valve operationally connected in fluidic communication with ,the hydrocarbon filter and the exhaust gas recirculation cooler;

wherein the exhaust manifold is adapted to emit exhaust gasses containing hydrocarbons when the engine is actuated;

wherein the valve is adapted to control the fluid flow between the hydrocarbon filter and the exhaust gas recirculation cooler;

wherein hydrocarbon-containing exhaust gasses exiting the exhaust manifold are routed through the hydrocarbon filter;

wherein at least some of the hydrocarbons passing through the hydrocarbon filter are removed from the exhaust gas;

wherein the filtered exhaust gasses exiting the hydrocarbon filter are circulated through the exhaust gas recirculation cooler and into the air intake for recirculation through the engine;

wherein removing the at least some of the hydrocarbons from the exhaust gasses retards buildup of hydrocarbon residue in the exhaust gas recirculation cooler;

wherein removal of the at least some of the hydrocarbons from the exhaust gasses reduces hydrocarbon emissions from the engine; and wherein hydrocarbons flowing through the coated pores are catalytically oxidized.

2. A for reducing hydrocarbon deposits in an exhaust, gas recirculation cooler in an internal combustion engine, comprising:

an air intake;

an internal combustion engine connected in fluidic communication with the air intake;

an exhaust manifold connected in fluidic communication with the internal combustion engine;

a hydrocarbon filter connected in fluidic communication with the exhaust manifold further comprising:

a microwave-absorbent refractory ceramic material adapted to allow fluid flow therethrough;

a microwave source;

a waveguide positioned to receive microwaves from the microwave source and direct them to the microwave-absorbent refractory ceramic material;

an exhaust gas recirculation cooler connected in fluidic communication with the hydrocarbon filter and connected in fluidic communication to the air intake; and a valve operationally connected in fluidic communication with the hydrocarbon filter and the exhaust gas recirculation cooler;

wherein the at least some of the hydrocarbons from the exhaust gasses deposit on the microwave-absorbent refractory ceramic material;

wherein the exhaust manifold is adapted to emit exhaust gasses containing hydrocarbons when the engine is actuated;

wherein the valve is adapted to control the fluid flow between the hydrocarbon filter and the exhaust gas recirculation cooler;

wherein hydrocarbon-containing exhaust gasses exiting the exhaust manifold are routed through the hydrocarbon filter;

wherein at least some of the hydrocarbons passing through the hydrocarbon filter are removed from the exhaust gas;

wherein the filtered exhaust gasses exiting the hydrocarbon filter are circulated through the exhaust gas recirculation cooler and into the air intake for recirculation through the engine;

wherein removing the at least some of the hydrocarbons from the exhaust gasses retards buildup of hydrocarbon residue in the exhaust gas recirculation cooler;

wherein removal of the at least some of the hydrocarbons from the exhaust gasses reduces hydrocarbon emissions from the engine;

wherein the microwave source may be selectively actuated to heat the microwave-absorbent refractory ceramic material past a predetermined temperature threshold; and wherein heating the microwave-absorbent refractory ceramic material past a predetermined temperature threshold actuates the oxidation of the hydrocarbons deposited in the hydrocarbon filter.

3. A diesel fuel exhaust system comprising:

an exhaust gas recirculation filter assembly positioned to receive exhaust gasses from a diesel engine exhaust manifold; and an exhaust gas recirculation cooler fluidically coupled to the exhaust gas recirculation filter and adapted to receive filtered exhaust gasses therefrom and recirculate cooled filtered exhaust gasses back into the engine;

wherein the exhaust gas recirculation filter assembly includes:

a porous refractory substrate adapted to allow fluidic communication therethrough; and a catalytic metal coating at least some of the pores;

wherein hydrocarbons flowing through the coated pores are catalytically oxidized.

4. A diesel fuel exhaust system comprising:

an exhaust gas recirculation filter assembly positioned to receive exhaust gasses from a diesel engine exhaust manifold; and an exhaust gas recirculation cooler fluidically coupled to the exhaust gas recirculation filter and adapted to receive filtered exhaust gasses therefrom and recirculate cooled filtered exhaust gasses back into the engine;

wherein the exhaust gas recirculation filter assembly includes:

a microwave-absorbent refractory ceramic material adapted to allow fluid flow therethrough;

a microwave source; and a waveguide positioned to receive microwaves from the microwave source and direct them to the microwave-absorbent refractory ceramic material;

wherein the at least some of the hydrocarbons from the exhaust gasses deposit on the microwave-absorbent refractory ceramic material;

wherein the microwave source may be selectively actuated to heat the microwave-absorbent refractory ceramic material past a predetermined temperature threshold; and wherein heating the microwave-absorbent refractory ceramic material past a predetermined temperature threshold actuates the oxidation of the hydrocarbons deposited in the hydrocarbon filter.

5. A method of removing hydrocarbons from internal combustion engine exhaust gasses, comprising the steps of:

a) providing an internal combustion engine having an air intake and an exhaust manifold, wherein the exhaust manifold emits exhaust gasses containing hydrocarbons when the engine is running;

b) providing a filter adapted to receive exhaust gasses from the exhaust manifold;

c) circulating exhaust gasses from the exhaust manifold into the filter;

d) removing at least some of the hydrocarbons from the exhaust gasses;

e) cooling filtered exhaust gasses; and f) recirculating filtered and cooled exhaust gasses into the air intake;

wherein the filter includes:

a microwave-absorbent refractory ceramic material adapted to allow fluid flow therethrough;

a microwave source;

a waveguide positioned to receive microwaves from the microwave source and direct them to the microwave-absorbent refractory ceramic material;

wherein the at least some of the hydrocarbons from the exhaust gasses deposit on the microwave-absorbent refractory ceramic material;

wherein the microwave source may be selectively actuated to heat the microwave-absorbent refractory ceramic material past a predetermined temperature threshold; and wherein heating the microwave-absorbent refractory ceramic material past a predetermined temperature threshold actuates the. oxidation of the hydrocarbons deposited in the filter.

6. A method of removing hydrocarbons from internal combustion engine exhaust gasses, comprising the steps of:

a) providing an internal combustion engine having an air intake and an exhaust manifold, wherein the exhaust manifold emits exhaust gasses containing hydrocarbons when the engine is running;

b) providing a filter adapted to receive exhaust gasses from the exhaust manifold;

c) circulating exhaust gasses from the exhaust manifold into the filter;

d) removing at least some of the hydrocarbons from the exhaust gasses;

e) cooling filtered exhaust gasses; and f) recirculating filtered and cooled exhaust gasses into the air intake;

wherein the filter includes:

a porous refractory substrate adapted to allow fluidic communication therethrough; and a catalytic metal including cerium and at least one element from column VIIIA and rows 5 and 6 of the periodic table coating at least some of the pores;

wherein hydrocarbons flowing through the coated pores are catalytically oxidized.

7. A method of removing engine exhaust by-products from internal combustion engine exhaust gasses, comprising the steps of:

a) providing an internal combustion engine having an air intake and an exhaust manifold, wherein the exhaust manifold emits exhaust gasses containing volatile combustion by products when the engine is running;

b) providing a filter adapted to receive exhaust gasses from the exhaust manifold;

c) circulating exhaust gasses from the exhaust manifold into the filter;

d) removing at least some of the volatile combustion by products from the exhaust gasses;

e) cooling filtered exhaust gasses; and f) recirculating filtered and cooled exhaust gasses into the air intake;

wherein the filter includes:

a porous refractory substrate adapted to allow fluidic communication therethrough; and a catalytic metal including cerium and at least one element from column VIIIA and rows 5 and 6 of the periodic table coating at least some of the pores;

wherein at least some of the volatile combustion by-products flowing through the coated pores are catalytically oxidized.

8. A method of removing engine exhaust by-products from internal combustion engine exhaust gasses, comprising the steps of:

a) providing an internal combustion engine having an air intake and an exhaust manifold, wherein the exhaust manifold emits exhaust gasses containing volatile combustion by products when the engine is running;

b) providing a filter adapted to receive exhaust gasses from the exhaust manifold;

c) circulating exhaust gasses from the exhaust manifold into the filter;

d) removing at least some of the volatile combustion by-products from the exhaust gasses;

e) cooling filtered exhaust gasses; and recirculating filtered and cooled exhaust gasses into the air intake;

wherein the filter includes:

a microwave-absorbent refractory ceramic material adapted to allow fluid flow therethrough;

a microwave source;

a waveguide positioned to receive microwaves from the microwave source and direct them to the microwave-absorbent refractory ceramic material;

wherein the at least some of the volatile combustion by-products from the exhaust gasses deposit on the microwave-absorbent refractory ceramic material;

wherein the microwave source may be selectively actuated to heat the microwave-absorbent refractory ceramic material past a predetermined temperature threshold; and wherein heating the microwave-absorbent refractory ceramic material past a predetermined temperature threshold actuates the oxidation of a predetermined amount of the volatile combustion by-products deposited in the filter.

9. The method of claim 8 further including the steps of:

after c) and instead of d), removing at least some of the volatile combustion by-products from the exhaust gasses by depositing the volatile combustion by-products in the filter; and occasionally heating the filter hot enough to oxidize the volatile combustion by-products deposited therein.

* * * * *